US008410988B2

(12) United States Patent
Iverson et al.

(10) Patent No.: US 8,410,988 B2
(45) Date of Patent: Apr. 2, 2013

(54) DUAL MODE ROTARY JOINT FOR PROPAGATING RF AND OPTICAL SIGNALS THEREIN

(75) Inventors: Derek E. Iverson, Kent, CA (US); Jonathan M. Saint Clair, Seattle, CA (US)

(73) Assignee: The Boeing Company, Chicago, IL (US)

( * ) Notice: Subject to any disclaimer, the term of this patent is extended or adjusted under 35 U.S.C. 154(b) by 1532 days.

(21) Appl. No.: 11/944,214

(22) Filed: Nov. 21, 2007

(65) Prior Publication Data

US 2012/0235882 A1 Sep. 20, 2012

(51) Int. Cl.
*H01Q 3/12* (2006.01)
*H01P 1/06* (2006.01)

(52) U.S. Cl. ..... 343/763; 333/257; 333/135; 385/26

(58) Field of Classification Search ..... 333/256, 333/257, 261, 135; 343/757, 763; 385/26
See application file for complete search history.

(56) References Cited

U.S. PATENT DOCUMENTS 4,725,796 A * 2/1988 Youree et al. ..... 333/135
4,922,214 A * 5/1990 Kalkert ..... 333/135
5,140,289 A * 8/1992 Andrieu et al. ..... 333/256
7,109,935 B2 9/2006 Saint Clair et al.

OTHER PUBLICATIONS

E.W. Mathews, et al., A Multi-Channel Rotary Joint for Spacecraft Applications, Microwave Symposium Digest, GMTT International, vol. 72, Issue 1, May 1972, pp. 157-159.

* cited by examiner

*Primary Examiner* — Benny Lee
(74) *Attorney, Agent, or Firm* — Yee & Associates, P.C.

(57) ABSTRACT

A dual mode rotary joint as described herein can be utilized in an electromagnetic communication system such as a radar system. The dual mode rotary joint can be used to rotatably couple an antenna architecture to its mounting structure. One embodiment of the dual mode joint includes a waveguide configured to propagate radio frequency (RF) signals, and endcaps coupled to the ends of the waveguide. Each endcap is reflective for RF signals and transmissive for optical signals.

18 Claims, 5 Drawing Sheets

DUAL MODE ROTARY JOINT FOR PROPAGATING RF AND OPTICAL SIGNALS THEREIN

TECHNICAL FIELD

Embodiments of the subject matter described herein relate generally to electromagnetic communication systems. More particularly, embodiments of the subject matter relate to a rotary joint for an electromagnetic communication system such as a radar system that includes a rotating antenna architecture.

BACKGROUND

Electromagnetic communication systems, such as microwave radar and antenna systems, have practical applications in the military, the commercial aircraft industry, and the telecommunication industry. Surveillance radar systems send high power radio frequency (RF) signals to a mechanically scanned antenna while simultaneously receiving one or more return channel signals in response to the transmit signals. Mechanically rotating antennas are utilized in a variety of radar systems and it is likely that they will continue to be used since they are generally less expensive than active antennas, and they don't suffer beam scan loss. Modern radars often incorporate multiple receiving apertures for the purpose of forming multiple simultaneous receive beams. The number of apertures can range from two (for monopulse) to a larger number (for example, up to fifteen) in order to support ground moving target indicator (GMTI) applications and/or to support increased volumetric coverage rates.

For mechanically scanned antennas, the RF transmit signals are routed through a rotary joint that connects the antenna to the adjacent mounting structure. It may be desirable at the same time to transfer other kinds of signals, such as discrete signals for polarization switching, through this rotary joint as well, but this is easily done with slip rings. An RF rotary joint needs to provide one or more high power paths for transmit signal(s), and at least one low power receive channel for return signal(s). Prior RF rotary joints are typically implemented mechanically with multiple concentric waveguide elements, but the structure becomes quite complicated as the number of channels increases.

Rotary joints have also been implemented in the optical portion of the electromagnetic spectrum. Such joints transmit one or more optical signals between halves of the joint through an enclosed optical path. A variety of multiplexing schemes can be used so that multiple optical signals can be transmitted and received and separated from each other.

SUMMARY OF THE INVENTION

A dual mode rotary joint (DMRJ) provides both an RF path, for high power transmit signals, and multiple optical paths, for multiple receive channels, in the same structure. Slip rings can be utilized for sending power and discrete signals through the joint. Such a joint is for use with an electromagnetic communication system such as a radar antenna. The dual mode rotary joint utilizes an improved configuration and implementation that reduces complexity and increases the number of receive channels, while maintaining good channel separation and reliability.

The above and other aspects may be carried out by an embodiment of a DMRJ for an electromagnetic communication system. The DMRJ includes a central waveguide with endcaps configured to propagate an RF signal, the endcaps being reflective for RF signals but transmissive for optical signals.

The above and other features may be found in an embodiment of an electromagnetic communication system having an antenna mounting structure, an antenna architecture, and a DMRJ coupled between the antenna mounting structure and the antenna architecture. The DMRJ is configured to accommodate rotation of the antenna architecture relative to the antenna mounting structure. The DMRJ includes a waveguide structure configured to propagate RF signals in a transmit direction and optical signals in a receive direction.

The above and other features may be found in an embodiment of a dual mode rotary joint for an electromagnetic communication system. The dual mode rotary joint includes: a first waveguide section configured to propagate RF signals in a transmit direction and optical signals in a receive direction; a second waveguide section configured to propagate RF signals in the transmit direction and optical signals in the receive direction, the second waveguide section being rotatably coupled to the first waveguide section to accommodate rotation of the first waveguide section and the second waveguide section relative to one another; a first optically transmissive electrically conductive endcap coupled to the first waveguide section and configured to reflect the RF signals and transmit the optical signals, the first optically transmissive electrically conductive endcap being positioned to allow the optical signals to enter the first waveguide section; and a second optically transmissive electrically conductive endcap coupled to the second waveguide section and configured to reflect the RF signals and transmit the optical signals, the second optically transmissive electrically conductive endcap being positioned to allow the optical signals to exit the second waveguide section.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION OF THE INVENTION

Figure 1:
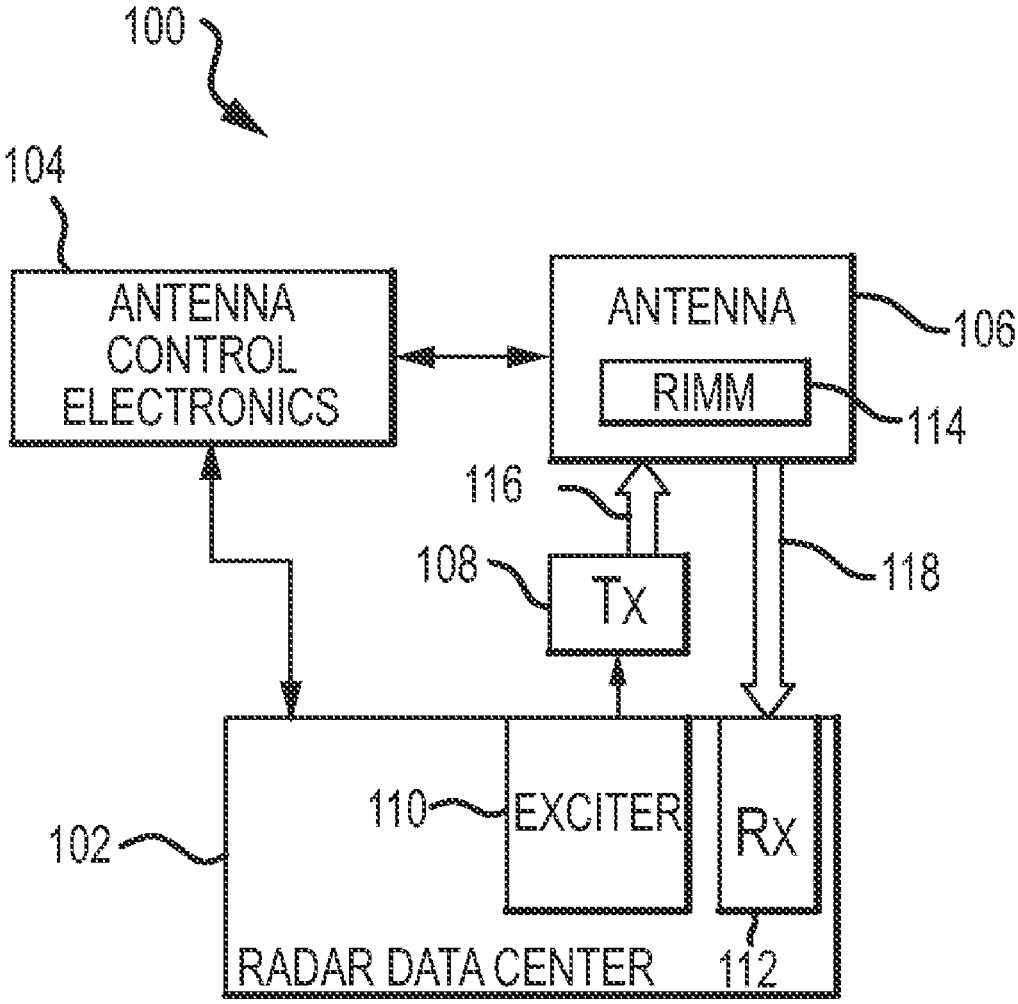
FIG. 1 is a schematic representation of an embodiment of an electromagnetic communication system.

The following detailed description is merely illustrative in nature and is not intended to limit the embodiments of the invention or the application and uses of such embodiments. Furthermore, there is no intention to be bound by any expressed or implied theory presented in the preceding technical field, background, brief summary or the following detailed description.

Techniques and technologies may be described herein in terms of functional and/or logical block components, and with reference to symbolic representations of operations, processing tasks, and functions that may be performed by various computing components or devices. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

The following description may refer to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although the schematic shown in FIG. 1 depicts one exemplary arrangement of elements, additional intervening elements, devices, features, or components may be present in an embodiment of the depicted subject matter.

For the sake of brevity, conventional techniques and features related to RF and microwave transmission, radar and antenna systems, waveguides, optical data transmission, rotary joints, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

An embodiment of a rotary joint configured as described herein combines features of an RF rotary joint with features of an optical rotary joint, such that it can provide a high power transmit signal and a large number of low power receive signals from multiple subapertures. In contrast, existing RF rotary joints are waveguide based, and multiple RF waveguides (channels) need to be fed continuously through the same limited, rotating structure. The maximum number of channels that can be practically achieved is about five (this includes both transmit and receive). There also exist optical rotary joints, which utilize traditional optical transmitters and receivers for the joint halves. The dual mode rotary joint described herein employs endcaps on the RF waveguide, where the endcaps are conductive/reflective at RF, while also being transparent/transmissive to optical signals. This allows the joint to emulate a solid metal waveguide at RF frequencies while concurrently acting as an aperture for transmitting and receiving optical signals through the joint. In certain practical embodiments, multiple wideband RF signals can be combined on a single (or a few) optical carriers and transmitted through the dual mode rotary joint with minimal interference and lower overall joint complexity.

FIG. 1 is a schematic representation of an embodiment of an electromagnetic communication system 100 in which a dual mode rotary joint may be deployed. For ease of description, system 100 is depicted in a very simplified manner in FIG. 1; an embodiment of system 100 will include a number of additional components and elements that need not be described in detail here. System 100 includes, without limitation: a radar data center 102; antenna control electronics 104 associated with radar data center 102; an antenna architecture 106 associated with radar data center 102; and a transmitter (TX) 108 associated with radar data center 102.

Radar data center 102 represents the main control and processing station for system 100. For this description, it is assumed that radar data center 102 is stationary relative to antenna architecture 106, which rotates relative to radar data center 102. In this regard, radar data center 102 may be realized as a ground-based, a ship-mounted, an aircraft-mounted, or a vehicle-mounted component. The illustrated embodiment of radar data center 102 includes an exciter 110 coupled to transmitter 108, and a receiver (RX) 112 coupled to antenna architecture 106. Exciter 110 is suitably configured to generate the excitation signals that in turn drive transmitter 108. Transmitter 108, which is coupled to antenna architecture 106, generates RF signals (in the transmit direction) in response to the operation of exciter 110. The RF signals generated by transmitter 108 drive antenna architecture 106, which emits RF energy at the desired frequencies. Receiver (RX) 112 is suitably configured to receive optical signals (in the receive direction) from antenna architecture 106. Receiver (RX) 112 may also include hardware, software, firmware, and/or processing logic that supports various data receiving and processing functions for radar data center 102. For example, receiver (RX) 112 may include or cooperate with one or more down converters, one or more digital receiver cards, digital signal processing logic, or the like.

Antenna control electronics 104 is utilized to control the movement, rotation, and direction of antenna architecture 106. Accordingly, FIG. 1 depicts antenna control electronics 104 being coupled to antenna architecture 106. Although FIG. 1 shows antenna control electronics 104 as a distinct block, an embodiment of system 100 may incorporate antenna control electronics 104 into radar data center 102. When the radar data center 102 wishes the antenna architecture 106 to point in a desired direction, or scan in a desired manner, information describing this goal is sent to the antenna control electronics 104. The antenna control electronics 104 translates this goal into the proper set of drive signals to move the antenna architecture 106.

Antenna architecture 106 is suitably configured to transmit relatively high power RF energy in the form of RF transmit signals and, in response to the RF transmit signals, receive relatively low power RF energy in the form of RF return/receive signals. This embodiment of antenna architecture 106 includes or cooperates with a Receiver Integrated Microwave Module (RIMM) 114, which is suitably configured to modulate an optical carrier signal in response to at least one RF receive signal received by antenna architecture 106. RIMM 114 includes or is realized as an optical modulator component that "converts" the relatively low power RF return signals into corresponding optical signals that are better suited for transmission through the DMRJ to radar data center 102. In practice, the RF return signals are used to modulate the optical carrier signal, resulting in optical return signals that can be processed by radar data center 102. It should be appreciated that antenna architecture 106, RIMM 114, the optical modulator(s) utilized by RIMM 114, and any corresponding logical elements, individually or in combination, are examples of a means for modulating the optical carrier signal.

For this embodiment, antenna architecture 106 can move (for example, rotate) relative to its antenna mounting structure. FIG. 1 does not separately depict the antenna mounting structure, however, radar data center 102 or a structural component thereof may serve as the antenna mounting structure for antenna architecture 106. As described in more detail below, rotation of antenna architecture 106 relative to its antenna mounting structure is facilitated by a dual mode rotary joint, where "dual mode" refers to its ability to propagate both RF signals (for example, RF transmit signals) and optical signals (for example, return signals) simultaneously. The dual mode rotary joint is coupled between antenna architecture 106 and its antenna mounting structure in a manner that accommodates rotation of antenna architecture 106 relative to the antenna mounting structure. In FIG. 1, the double lined arrows 116/118 represent the signal paths through the dual mode rotary joint. The arrow 116 indicates the propagation of RF signals in the transmit direction, and the arrow 118 indicates the propagation of optical signals in the receive direction. In system 100, transmitter 108 and receiver 112 are both coupled to antenna architecture 106 via this dual mode rotary joint.

Figure 2:
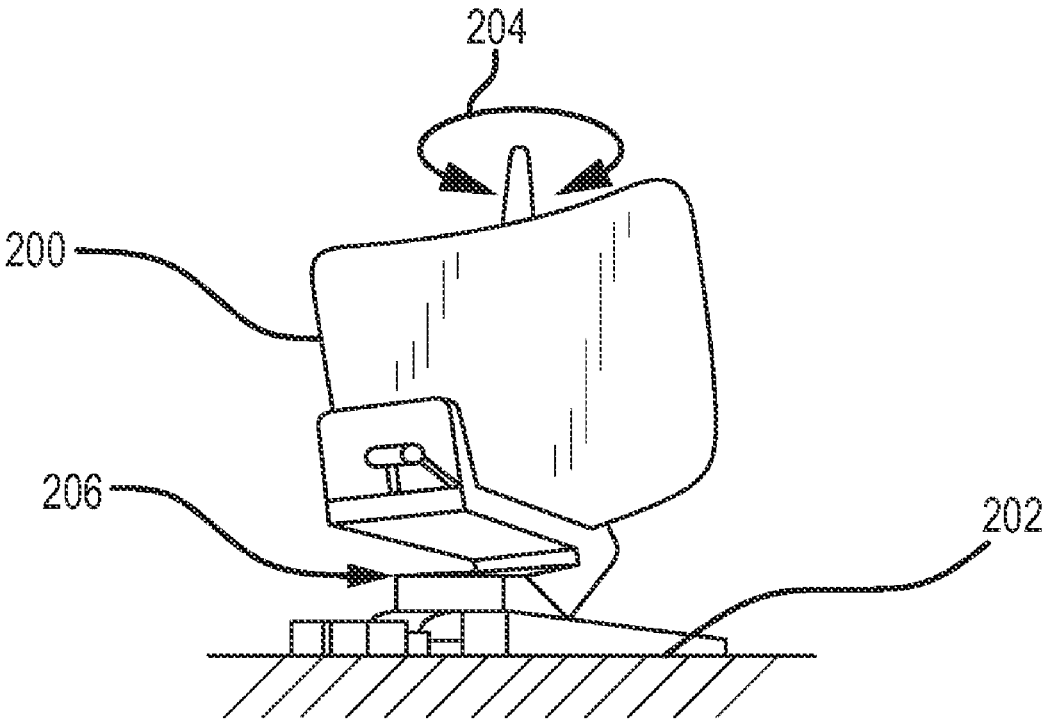
FIG. 2 is a perspective view of an embodiment of a rotatable antenna architecture.

FIG. 2 is a perspective view of an embodiment of a rotatable antenna architecture 200 suitable for use in an electromagnetic communication system such as system 100 of FIG. 1. FIG. 2 shows an antenna mounting structure 202 for antenna architecture 200. Antenna mounting structure 202 remains stationary relative to antenna architecture 200, which is suitably configured to rotate relative to antenna mounting structure 202. The arrow 204 in FIG. 2 generally indicates the axis of rotation of antenna architecture 200. Antenna architecture 200 is coupled to antenna mounting structure 202 via a dual mode rotary joint 206 that is configured to simultaneously propagate RF energy (in the transmit direction) and optical signals (in the receive direction).

Figure 3:
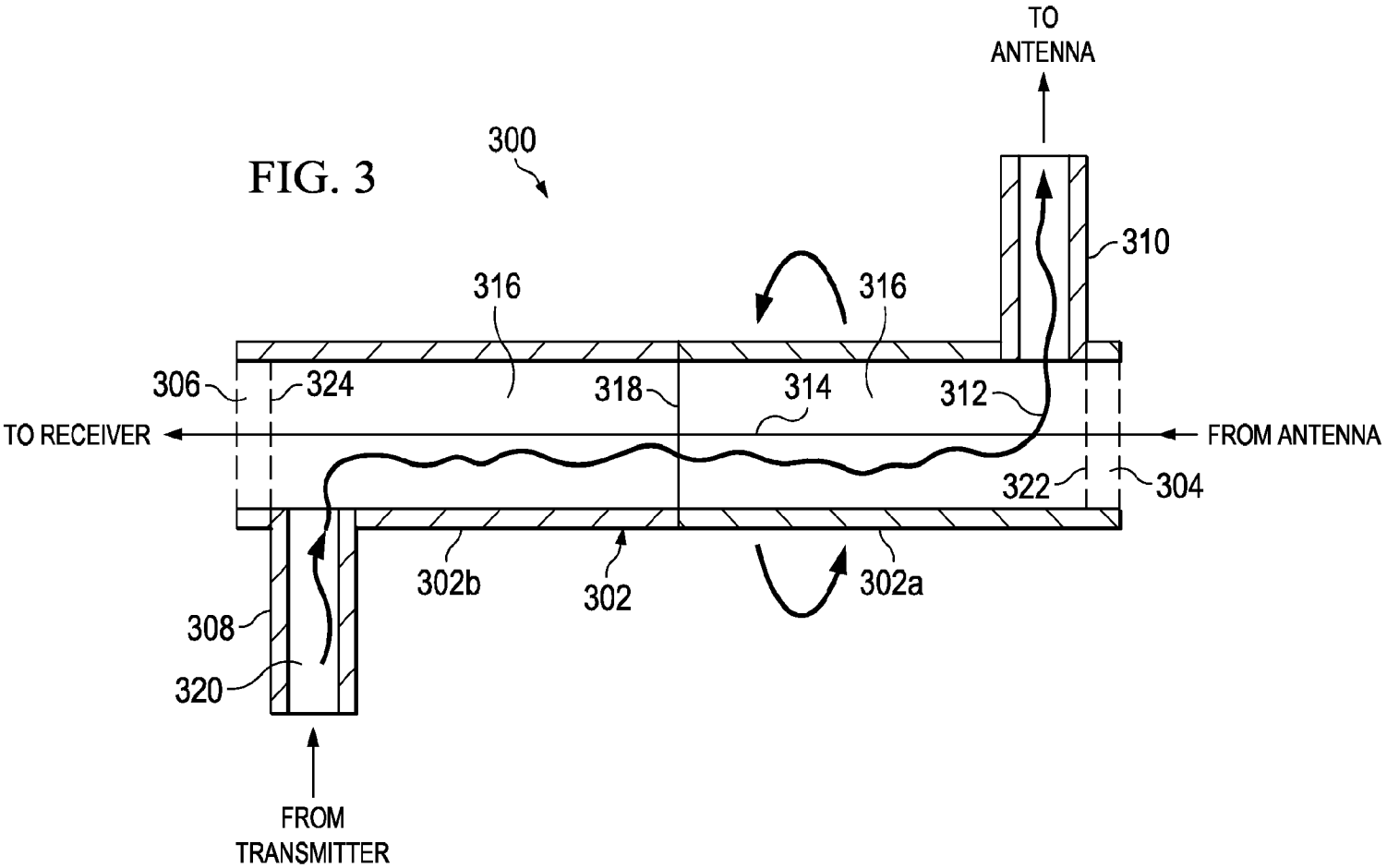
FIG. 3 is a schematic phantom view of an embodiment of a dual mode rotary joint.

FIG. 3 is a schematic phantom view of an embodiment of a dual mode rotary joint 300 suitable for use in an electromagnetic communication system such as system 100. Dual mode rotary joint 300 generally includes, without limitation: a waveguide 302; a first endcap 304 for waveguide 302; a second endcap 306 for waveguide 302; an input waveguide transition 308; and an output waveguide transition 310. The combination of waveguide 302, first and second endcaps 304/306, input waveguide transition 308, and output waveguide transition 310 form a waveguide structure for dual mode rotary joint 300. In FIG. 3, the arrow 312 represents RF signals or RF energy propagating through waveguide 302, and the arrow 314 represents optical signals propagating through waveguide 302.

Dual mode rotary joint 300 allows RF signals 312 to pass through waveguide 302 (from the transmitter side to the antenna side) while simultaneously allowing optical signals 314 to pass through waveguide 302 (from the antenna side to the receiver side) as it rotates. The return signal path could be implemented in a variety of ways in the optical domain. For example, multiple return signals could be wave division multiplexed onto a single optical carrier and passed through dual mode rotary joint 300. First and second endcaps 304/306 utilize material that is transparent to optical transmission but appears as normal waveguide wall material at RF frequencies of interest. The optical transmitters and receivers could be implemented within first and second endcaps 304/306, or they could be remotely implemented and connected to first and second endcaps 304/306 using optical conduit, such as optical fiber, between dual mode rotary joint 300 and the antenna architecture (and/or the receiver).

Due to the use of optical return paths, dual mode rotary joint 300 need not implement multiple RF waveguides in the same physical package. The optical transmitters and receivers are circularly polarized so as to not be sensitive to the rotation of the optical signal (to polarization), therefore, no special mechanism is required to support rotation. First and second endcaps 304/306 are formed in such a way as to not interfere with the desired waveguide properties of the RF path. Although FIG. 1 depicts an embodiment for one RF channel, dual mode rotary joint 300 could be configured to support a plurality of RF channels if one wanted to have a dual frequency aperture, such as one incorporating an X-band radar and an L-band IFF interrogator, by incorporating a two channel RF joint with the optical modifications described herein. By a variety of optical multiplexing techniques it is also possible to transmit multiple channels of RF return information on a single optical signal, or multiple optical signals that utilize the same optical path through the rotary joint. After receipt of this optical signal on the fixed side of dual mode rotary joint 300, it can be demultiplexed into the respective channels, reconverted to RF and then digitally sampled in the receiver.

Waveguide 302 is configured to propagate RF energy, such as RF transmit signals for an antenna architecture. Waveguide 302 has an interior 316 that is shaped, sized, and finished to facilitate propagation of RF energy having specified frequency and power characteristics. For example, waveguide 302 may be configured to propagate RF signals within the frequency band of 9.5 to 10.5 GHz. Accordingly, interior 316 of waveguide 302 is conductive/reflective for RF signals. In certain embodiments, waveguide 302 is formed from conductive metal such as, without limitation: copper; copper-beryllium; aluminum; or silver.

The illustrated embodiment of dual mode rotary joint 300 includes a first waveguide section 302*a* and a second waveguide section 302*b* that is rotatably coupled to first waveguide section 302*a*. The line 318 in FIG. 3 schematically represents the rotating junction between first waveguide section 302*a* and second waveguide section 302*b*. This configuration accommodates rotation of first waveguide section 302*a* and second waveguide section 302*b* relative to one another. For this particular example, first waveguide section 302*a* rotates while second waveguide section 302*b* remains stationary. The longitudinal axis of waveguide 302 corresponds to the axis of rotation of first waveguide section 302*a*. In practical embodiments, interior 316 of waveguide 302 has a circular longitudinal cross section, which facilitates rotation without introducing discontinuities that might otherwise impact the propagation of RF energy through waveguide 302.

Input waveguide transition 308 is coupled to second waveguide section 302*b*, preferably near second endcap 306. Input waveguide transition 308 is suitably configured to propagate RF signals into second waveguide section 302*b*. Thus, input waveguide transition 308 has an interior 320 that is shaped, sized, and finished to facilitate propagation of RF energy having specified frequency and power characteristics. Accordingly, interior 320 of input waveguide transition 308 is conductive/reflective for RF signals. In certain embodiments, input waveguide transition 308 is formed from conductive metal such as, without limitation: copper; copper-beryllium; aluminum; or silver. For this particular embodiment, input waveguide transition 308 is realized as a ninety degree transition into waveguide 302, and interior 320 of input waveguide transition 308 may have a rectangular cross sectional shape.

Output waveguide transition 310 is coupled to first waveguide section 302*a*, preferably near first endcap 304.

Output waveguide transition 310 is suitably configured to propagate RF signals out of first waveguide section 302*a*. The configuration, design, and functionality of output waveguide transition 310 is otherwise identical or equivalent to that described above for input waveguide transition 308.

First endcap 304 is coupled to or integrated into first waveguide section 302*a*. As depicted in FIG. 3, first endcap 304 is located at or near one of the two longitudinal ends of waveguide 302. In this embodiment of dual mode rotary joint 300, first endcap 304 is positioned to allow optical signals 314 to enter first waveguide section 302*a*. First endcap 304 is suitably configured to be both optically transmissive (e.g., transmissive for optical signals) and electrically conductive/reflective (e.g., reflective for RF signals). In particular, first endcap 304 is configured to reflect RF signals 312 propagated by waveguide 302, and to transmit optical signals 314 carried by waveguide 302.

First endcap 304 has a first side 322 that faces the interior 316 of waveguide 302. In certain embodiments, first side 322 is configured to reflect RF energy propagating through the interior 316 of waveguide 302. In this regard, first endcap 304 may have an optically transmissive electrically conductive element, material, and/or coating formed on first side 322. For example, first side 322 may include an indium tin oxide material formed thereon. Alternatively (or additionally), first endcap 304 may include an electrically conductive material arranged in a grid pattern, where the material is located on first side 322. The grid pattern is shaped and sized to reflect RF energy while still allowing optical signals to pass through the spaces defined by the grid pattern. This approach is described in the context of an antenna design in U.S. Pat. No. 7,109,935, the relevant content of which is incorporated by reference herein.

In some embodiments, first endcap 304 includes an optically transmissive substrate and an optically transmissive and electrically conductive material or element formed on the optically transmissive substrate. The substrate can be fabricated from a substantially electrically nonconductive material that is optically transparent/transmissive to optical, e.g., laser, signals having a wavelength within a specific portion of the optical spectrum. For example, the substrate could be optically transparent to optical signals having a wavelength between 1.0 μm and 2.0 μm. Alternatively, the substrate could be optically transparent to optical signals in various other optical bands, such as the visible near infrared, the mid wave infrared, or long wave infrared wavelength bands. In certain embodiments the substrate is fabricated from a dichroic material such as glass, quartz, or any other material that has good electromagnetic properties (e.g., low loss tangent, good isotropic quality, temperature stability) and is amenable to printed circuit manufacturing.

The optically transmissive electrically conductive material or element can be disposed on the substrate using vapor disposition, lithography, or similar coating approaches. In various embodiments, the optically transmissive electrically conductive element can be fabricated from an indium tin oxide, gold arranged in a grid, or any other material that has good electrical conductive properties (such as high conductive loss resistivity) and can be deposited onto the substrate. In one implementation, the optically transmissive electrically conductive element is realized as gold deposited onto the substrate in a rectilinear grid or mesh using lithography. That is, the element is not solid, but it forms a screen-like pattern on the substrate. Therefore, optical signals are allowed to pass through the openings in the grid. Operation of first endcap 304 for both the optical and electromagnetic performance is influenced by the design parameters of the grid. More specifically, there is a tradeoff between optical and electromagnetic performance depending on the specification of the grid on the substrate. The size of the grid openings is determined based on the frequency of the optical signals desired to pass through the grid. For a tighter grid (i.e., smaller openings in the grid), the optical signals must have a shorter wavelength to pass through. However, for a wider the grid (i.e., larger openings in the grid), the optical signals can have a longer wavelength.

Second endcap 306 is coupled to or integrated into second waveguide section 302*b*. As depicted in FIG. 3, second endcap 306 is located at or near one of the two longitudinal ends of waveguide 302. In this embodiment, first endcap 304 and second endcap 306 are located at opposite ends of waveguide 302. Second endcap 306 is positioned to allow optical signals 314 to exit second waveguide section 302*b*. Second endcap 306 is suitably configured to be both optically transmissive (e.g., transmissive for optical signals) and electrically conductive/reflective (e.g., reflective for RF signals). In particular, second endcap 306 is configured to reflect RF signals 312 propagated by waveguide 302, and to transmit optical signals 314 carried by waveguide 302.

Second endcap 306 has a first side 324 that faces the interior 316 of waveguide 302. In certain embodiments, first side 324 is configured to reflect RF energy propagating through the interior 316 of waveguide 302. In this regard, second endcap 306 may have an optically transmissive electrically conductive element, material, and/or coating formed on first side 324, as described in detail above for first endcap 304.

The waveguide structure of dual mode rotary joint 300 is suitably configured to simultaneously propagate at least one RF transmit channel in the transmit direction and a plurality of optical signal channels in the receive direction. In preferred embodiments, waveguide 302 is used only for high power RF transmit energy, and all of the return signals carried by dual mode rotary joint 300 are realized in the optical domain. In practical embodiments, dual mode rotary joint 300 also provides electrical power to the active elements on the rotating antenna architecture. These active elements may include, without limitation: LNAs, RF to optical converters, power components, or the like. To accommodate the delivery of power, certain embodiments of dual mode rotary joint 300 include an electrical slip ring architecture coupled between first and second waveguide sections 302*a*/302*b*.

Figure 4:
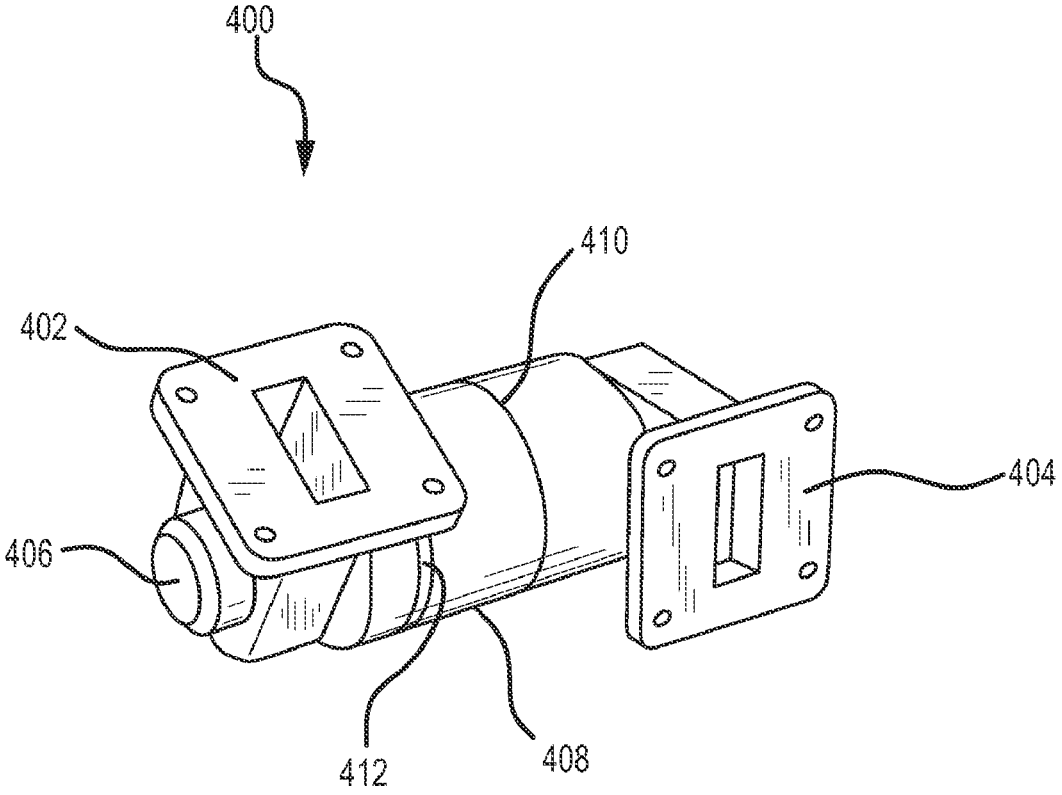
FIG. 4 is a perspective view of an embodiment of a dual mode rotary joint.

FIG. 4 is a perspective view of an embodiment of a dual mode rotary joint 400 having the features described above. Dual mode rotary joint 400 includes an input waveguide transition 402, an output waveguide transition 404, and optically transmissive electrically conductive endcaps 406 (only one is visible in FIG. 4). For consistency with dual mode rotary joint 300 of FIG. 3. FIG. 4 includes a split waveguide 408 that rotates at a junction 410. Alternatively, dual mode rotary joint 400 could be designed to rotate at or near an endcap 406. For example, dual mode rotary joint 400 may be suitably configured to rotate at a junction 412 that is located close to an end of waveguide 408. Other than the location of the rotating junction, dual mode rotary joint 400 functions in the manner described above for dual mode rotary joint 300 of FIG. 3.

While at least one example embodiment has been presented in the foregoing detailed description, it should be appreciated that a vast number of variations exist. It should also be appreciated that the example embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

Figure 5:
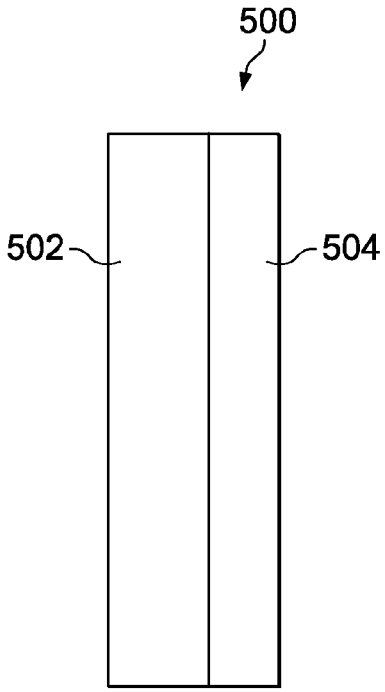
FIG. 5 is an illustration of an end cap.

FIG. 5 is an illustration of an end cap. FIG. 5 shows a view of either first end cap 304 or second end cap 306 shown in FIG. 3. Thus, end cap 500 may be either first end cap 304 or second end cap 306 shown in FIG. 3. End cap 500 may include optically transmissive substrate 502. End cap 500 may also include optically transmissive electrically conductive element 504 on optically transmissive substrate 502.

Figure 6:
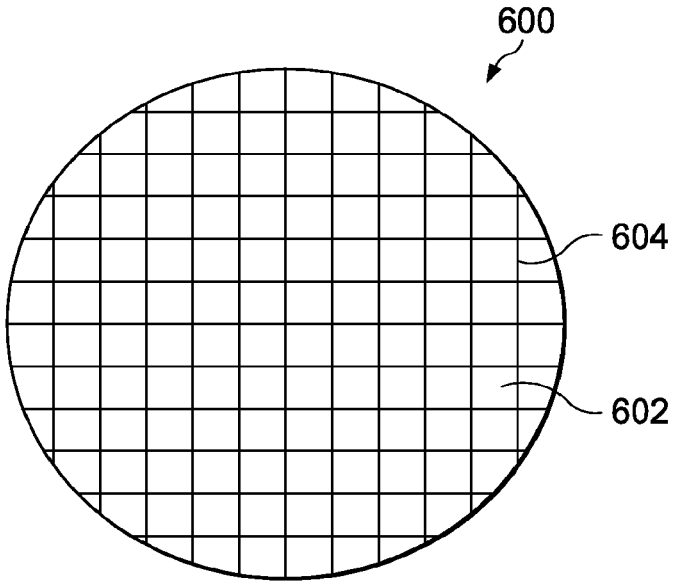
FIG. 6 is an illustration of an end cap.

FIG. 6 is an illustration of an end cap. FIG. 6 shows a view of either first end cap 304 or second end cap 306 shown in FIG. 3. Thus, end cap 600 may be either first end cap 304 or second end cap 306 shown in FIG. 3, and end cap 600 may also be end cap 500 of FIG. 5. Optically transmissive electrically conductive element 600 may include optically tranmissive substrate 602 and optically transmissive electrically conductive material 604 arranged in a grid pattern, as shown in FIG. 6. Optically transmissive electrically conductive material 604 may be optically transmissive electrically conductive element 504 of FIG. 5.

What is claimed is:

1. A dual mode rotary joint for an electromagnetic communication system, the dual mode rotary joint comprising:

a waveguide configured to propagate radio frequency (RF) signals; and an endcap coupled to the waveguide, the endcap being reflective for RF signals and transmissive for optical signals, wherein the endcap comprises:

an optically transmissive substrate; and an optically transmissive electrically conductive element on the optically transmissive substrate.

2. The dual mode rotary joint of claim 1, wherein:

the waveguide has an interior; and wherein the optically transmissive electrically conductive element is disposed on a first side of the endcap facing the interior of the waveguide, the optically transmissive electrically conductive element being configured to reflect RF energy of the RF signal propagating through the interior of the waveguide.

3. The dual mode rotary joint of claim 1, further comprising a second endcap coupled to the waveguide, the second endcap being reflective for the radio frequency (RF) signals and transmissive for the optical signals, wherein the endcap and the second endcap are located at opposite ends of the waveguide.

4. The dual mode rotary joint of claim 1, further comprising:

an input waveguide transition coupled to the waveguide, the input waveguide transition being configured to propagate the radio frequency (RF) signals into the waveguide; and an output waveguide transition coupled to the waveguide, the output waveguide transition being configured to propagate the radio frequency (RF) signals out of the waveguide.

5. The dual mode rotary joint of claim 1, the waveguide comprising:

a first section including the endcap; and a second section rotatably coupled to the first section, the first section and the second section being configured to rotate relative to one another.

6. The dual mode rotary joint of claim 1, wherein the optically transmissive electrically conductive element comprises an electrically conductive material arranged in a grid pattern.

7. The dual mode rotary joint of claim 1, wherein the optically transmissive electrically conductive element comprises an indium tin oxide material.

8. A dual mode rotary electromagnetic communication system comprising:

an antenna mounting structure;

an antenna architecture;

a dual mode rotary joint coupled between the antenna mounting structure and the antenna architecture, the dual mode rotary joint being configured to accommodate rotation of the antenna architecture relative to the antenna mounting structure, and the dual mode rotary joint comprising a waveguide structure configured to propagate radio frequency (RF) signals in a transmit direction; and means for modulating an optical carrier signal in response to at least one RF signal received by the antenna architecture thereby resulting in optical signals propagating in a receive direction.

9. The system of claim 8, wherein the waveguide structure further comprises an endcap, the endcap comprising an optically transmissive substrate and an optically transmissive electrically conductive element on the optically transmissive substrate.

10. The system of claim 8, further comprising a transmitter coupled to the antenna architecture via the dual mode rotary joint, the transmitter being configured to generate the RF signals in the transmit direction.

11. The system of claim 8, further comprising a receiver coupled to the antenna architecture via the dual mode rotary joint, the receiver being configured to receive the optical signals in the receive direction.

12. The system of claim 8, wherein the waveguide structure comprises:

a waveguide configured to propagate RF energy of the RF signals;

a first optically transmissive electrically conductive endcap for the waveguide, located on a first end of the dual mode rotary joint, and configured to reflect the RF energy and transmit the optical signals; and a second optically transmissive electrically conductive endcap for the waveguide, located on a second end of the dual mode rotary joint, and configured to reflect the RF energy and transmit the optical signals.

13. The system of claim 8, wherein the waveguide structure comprises:

an input waveguide transition configured to propagate the radio frequency (RF) signals into the waveguide structure; and an output waveguide transition configured to propagate the radio frequency (RF) signals out of the waveguide structure.

14. The system of claim 8, wherein the waveguide structure is configured to simultaneously propagate at least one RF transmit channel in the transmit direction and a plurality of optical signal channels in the receive direction.

15. The system of claim 8, further comprising an optical conduit coupled between the antenna architecture and the dual mode rotary joint, the optical conduit being configured to propagate the optical signals from the antenna architecture to the dual mode rotary joint.

16. A dual mode rotary joint for an electromagnetic communication system, the dual mode rotary joint comprising:

a first waveguide section configured to propagate radio frequency (RF) signals in a transmit direction and optical signals in a receive direction;

a second waveguide section configured to propagate the radio frequency (RF) signals in the transmit direction and the optical signals in the receive direction, the second waveguide section being rotatably coupled to the first waveguide section to accommodate rotation of the first waveguide section and the second waveguide section relative to one another;

a first optically transmissive electrically conductive endcap coupled to the first waveguide section and configured to reflect the RF signals and transmit the optical signals, the first optically transmissive electrically conductive endcap being positioned to allow the optical signals to enter the first waveguide section; and a second optically transmissive electrically conductive endcap coupled to the second waveguide section and configured to reflect the RF signals and transmit the optical signals, the second optically transmissive electrically conductive endcap being positioned to allow the optical signals to exit the second waveguide section;

wherein each of the first optically transmissive electrically conductive endcap and the second optically transmissive electrically conductive endcap comprises:

a corresponding optically transmissive substrate; and a corresponding optically transmissive electrically conductive material formed on the corresponding optically transmissive substrate.

17. The dual mode rotary joint of claim 16, further comprising an electrical slip ring architecture coupled between the first waveguide section and the second waveguide section.

18. The dual mode rotary joint of claim 16, further comprising:

an input waveguide transition coupled to the second waveguide section, the input waveguide transition being configured to propagate the RF signals into the second waveguide section; and an output waveguide transition coupled to the first waveguide section, the output waveguide transition being configured to propagate the RF signals out of the first waveguide section.

* * * * *